US007018308B2

(12) United States Patent
Kasashima

(10) Patent No.: US 7,018,308 B2
(45) Date of Patent: Mar. 28, 2006

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/392,968

(22) Filed: Mar. 21, 2003

(65) Prior Publication Data

US 2003/0190968 A1 Oct. 9, 2003

(30) Foreign Application Priority Data

Mar. 29, 2002 (JP) ..... 2002-094285

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 5,005,838 A 4/1991 Oka
6,290,615 B1 9/2001 Ogg
6,569,038 B1 * 5/2003 Sullivan ..... 473/383

FOREIGN PATENT DOCUMENTS

JP 02-068077 B2 3/1990

* cited by examiner

*Primary Examiner*—Raeann Gorden
(74) *Attorney, Agent, or Firm*—Sughrue Mion, PLLC

(57) ABSTRACT

A golf ball includes a multiplicity of dimples on its outer surface. At least one or more of the multiplicity of dimples are each configured to have a convex bottom portion formed by a circular-arc defined by a center positioned inside the ball and a curvature radius "r" mm smaller than a radius "R" mm of the ball but larger than a value (R−0.5) mm. The golf ball specified such that the shapes of the dimples are optimized as described above exhibits high flight characteristics.

12 Claims, 4 Drawing Sheets

GOLF BALL

BACKGROUND OF THE INVENTION

The present invention relates to a golf ball excellent in flight characteristics.

As is well known, to improve flight characteristics of a golf ball, that is, to obtain the largest travel distance of the ball hit with a golf club, it is important to increase the resilience of the ball and to reduce the air resistance during flight caused by dimples arranged on the outer surface of the ball. With respect to the latter factor, from the viewpoint of reducing the air resistance caused by the dimples, various attempts have been made to improve the shapes of the dimples, to improve the arrangement of the dimples so as to distribute the dimples as uniformly and densely as possible, and to obtain the optimum ratio of dimple volumes to the total volume of the ball.

The shape of a dimple in a plan view is generally circular, and the shape of a dimple in a cross-sectional view is generally selected from various kinds of shapes. The first cross-sectional shape of the dimple is a nearly circular-arc shape as a whole. To be more specific, as shown in the cross-section of FIG. 6, an outline, extending from both edges to a bottom portion via side walls, of a dimple is formed by a circular-arc defined by a curvature radius "f" and the center positioned outside the golf ball. In the figure, reference numeral 1 denotes the golf ball, 2 is the dimple, 3 is the edge of the dimple, 4 is the side wall of the dimple, and 5 is the bottom portion of the dimple, and further, character "O" denotes the center of the golf ball, "R" is the radius of the golf ball, "f" is the curvature radius of the wall surface of the dimple 2 the center of which is "P" positioned outside the ball, and "i" is the depth of the dimple.

The known second cross-sectional shape of the dimple is a double shape composed of a combination of a large circular-arc and a small circular-arc. In general, the side wall portion is formed by the large-circular arc and the bottom portion is formed by the small circular-arc. The third cross-sectional shape of the dimple is configured such that the bottom portion is formed into a shape similar to that of the bottom of a pot or a shape similar to that of a caldera. The caldera shape is a modification of the double shape, wherein the bottom portion formed by a small circular-arc projects outwardly from the ball.

Nevertheless, it has been expected yet to obtain more desirable flight characteristics of a golf ball by improving the shapes of dimples.

SUMMARY OF THE INVENTION

An object of the present invention is to provide a golf ball including dimples on its outer surface, which is capable of improving flight characteristics thereof by optimizing shapes of the dimples.

To achieve the above object, according to an aspect of the present invention, there is provided a golf ball including a multiplicity of dimples on its outer surface, wherein at least one or more of the multiplicity of dimples are each configured to have a convex bottom portion formed by a circular-arc defined by a center positioned inside the ball and a curvature radius "r" mm smaller than a radius "R" mm of the ball but larger than a value (R−0.5) mm.

The dimple having the convex bottom portion is preferably formed into a circular shape in a plan view.

The dimple having the convex bottom portion is also preferably formed into a non-circular shape in a plan view.

In the golf ball, preferably, a ratio CL/CD of a lift coefficient CL to a drag coefficient CD of the ball during flight thereof is in a range of 0.676 to 0.796 under a condition with a Reynolds number of 200,000 and a spin rate of 2,700 rpm, in a range of 0.813 to 0.933 under a condition with a Reynolds number of 12,000 and a spin rate of 2,400 rpm, and in a range of 0.856 to 0.976 under a condition with a Reynolds number of 80,000 and a spin rate of 2,000 rpm.

According to the present invention, unlike the prior art cross-sectional shapes of dimples, at least one or more of a multiplicity of dimples are each configured to have a bottom portion whose shape is specified to significantly smoothen the surface of the golf ball. As a result, it is possible to improve flight characteristics of the golf ball.

BRIEF DESCRIPTION OF THE DRAWINGS

These and other objects, features, and advantages of the present invention will be more apparent from the following detailed description taken in conjunction with the accompanying drawings, in which.

DESCRIPTION OF THE PREFERRED EMBODIMENTS

The present invention will now be described with reference to FIGS. 1 to 5.

Figure 1:
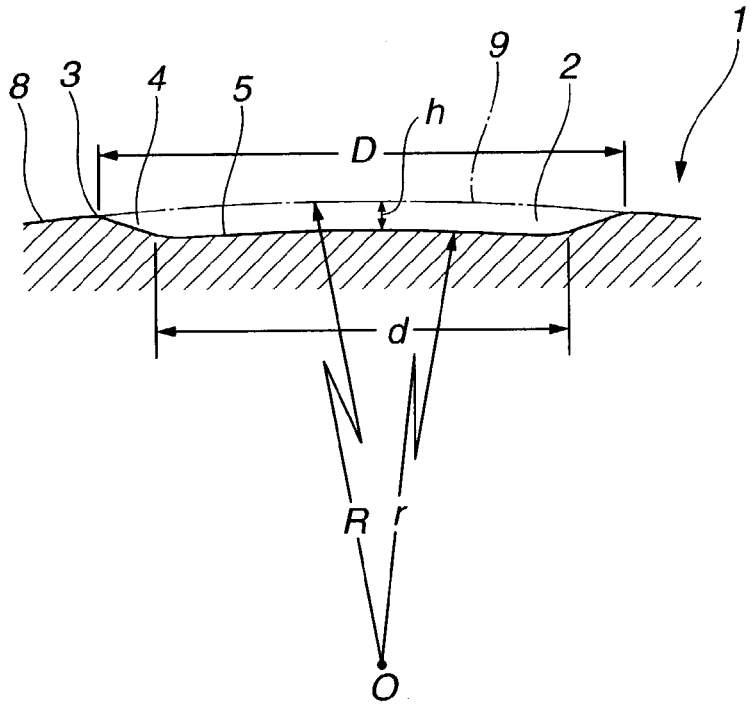
FIG. 1 is a sectional view of a dimple provided on a golf ball according to the present invention, which view is cut away along a plane passing through the center of the dimple.
Figure 2:
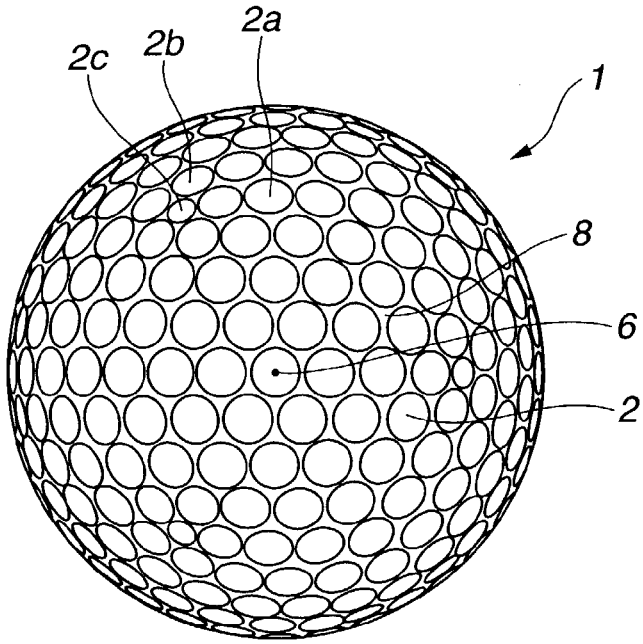
FIG. 2 is a plan view of one example of the golf ball according to the present invention, which view is seen from a polar side of the golf ball.

FIG. 1 is a sectional view of a dimple of the present invention, which view is cut away along a plane passing through the center of the dimple. FIG. 2 is a plan view of one example of the golf ball including the dimples shown in FIG. 1, which view is seen from a polar side of the golf ball, and FIG. 3 is a side view of the golf ball shown in FIG. 1, which view is seen from the equator side of the golf ball.

Figure 6:
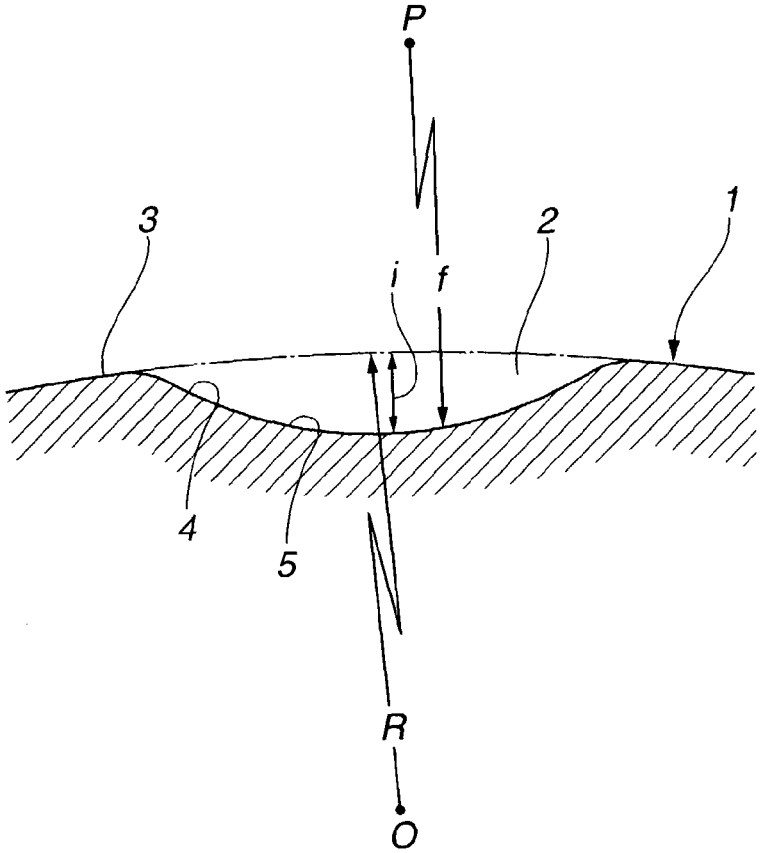
FIG. 6 is a sectional view of a dimple of a golf ball according to a Comparative Example, which view is cut away along a plane passing through the center of the dimple.

In these figures, like FIG. 6, reference numeral 1 denotes a golf ball, 2 is a dimple, 3 is the edge of the dimple, 4 is a side wall of the dimple, 5 is a bottom portion of the dimple, and further, character "O" denotes the center of the golf ball, and "R" is a radius of the golf ball. In addition, reference numeral 6 denotes a pole, 7 is the equator, and 8 is a land.

Figure 3:
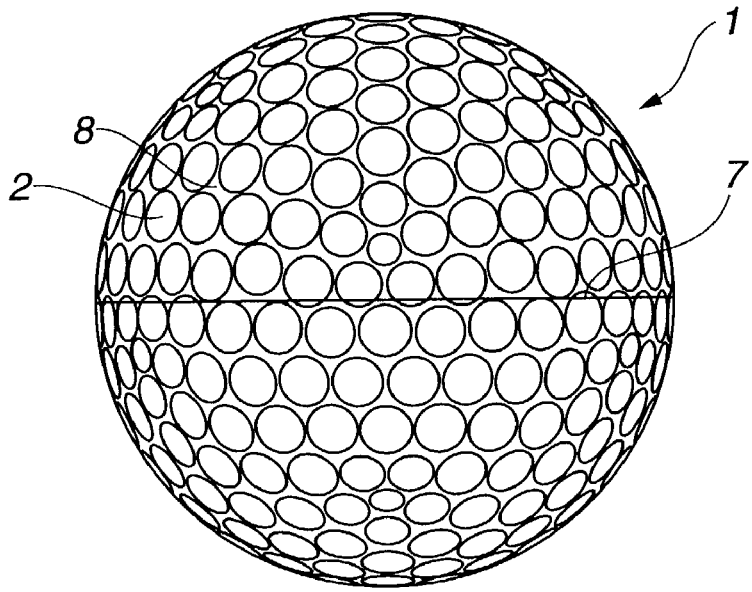
FIG. 3 is a side view of the golf ball shown in FIG. 2, which view is seen from the equator side of the golf ball.

Referring to FIGS. 2 and 3, a golf ball 1 has a multiplicity of dimples 2 each of which is formed into a circular shape in a plan view. In this case, according to the present invention, at least one or more of the dimples 2 are each configured to have a convex bottom portion shown in FIG. 1. The convex bottom portion is substantially formed by a circular-arc defined by a center positioned inside the ball and a radius "r" mm smaller than a radius "R" mm of the ball but larger than a value (R−0.5) mm.

The number of the dimples on a ball surface is preferably in a range of 300 or more, more preferably, 330 or more, and preferably, 550 or less, more preferably, 500 or less.

Figure 7:
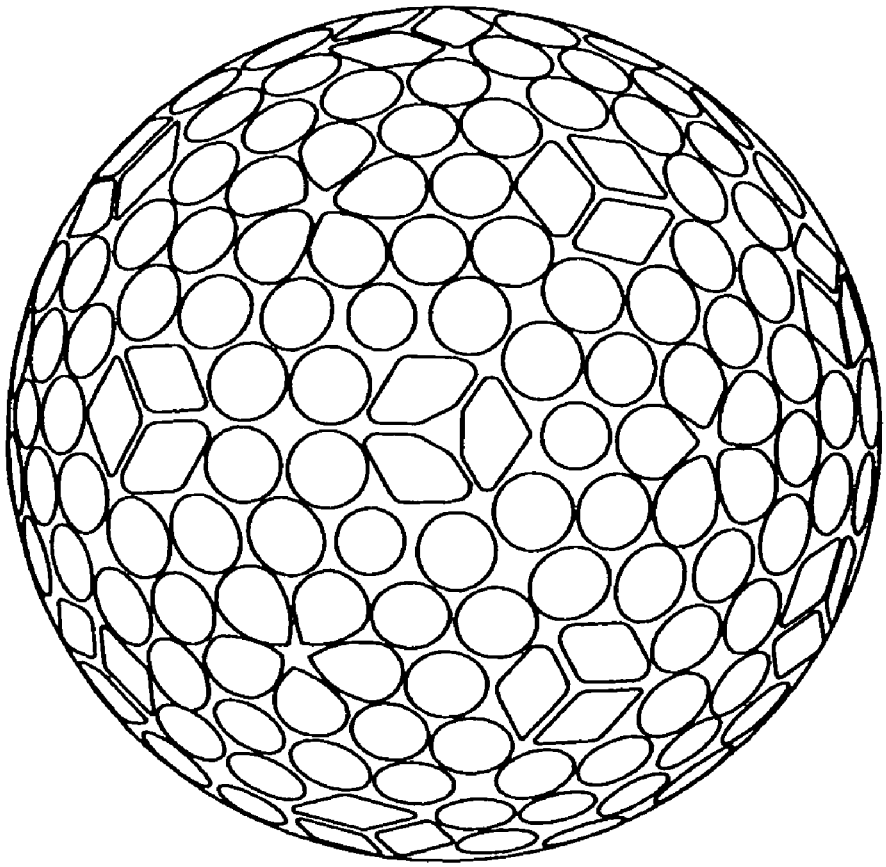
FIG. 7 is an illustrative view of a golf ball having dimples of non-circular shape.

The shape, surrounded by the edge, of the dimple is not limited to a circular shape shown in FIGS. 2 and 3 but may be a non-circular shape, examples of which include a polygonal shape such as a triangular, quadrilateral, or hexagonal shape, an elliptic or oval shape, a petal shape, a heart shape, a star shape, a dewdrop shape, and a combination thereof (FIG. 7). If the edge of the dimple is formed into such a non-circular shape in a plan view, the bottom portion of the dimple may be similarly formed into a non-circular shape in a plan view.

The edge of the dimple is, however, preferable to be formed into a circular shape. In this case, the diameter of the dimple is preferably in a range of 2.0 mm or more, more preferably, 2.5 mm or more, and preferably, 6.0 mm or less, more preferably, 5.0 mm or less.

According to the present invention, the kind of the dimples is not limited to one, but is preferably in a range of two or more, more preferably, three or more, and generally, eight or less, particularly, six or less. The golf ball shown in FIG. 2 has three kinds of dimples: large dimples 2*a,* middle dimples 2*b,* and small dimples 2*c.*

According to the present invention, as described above, part or all of the dimples are each configured to have a convex bottom portion formed by a circular-arc defined by the radius "r" mm smaller than the radius "R" mm of the ball but larger than the value (R−0.5) mm. That is to say, the radii "r" and "R" satisfy the following relationship:

$$R>r>R-0.5$$

In this case, from the viewpoint of flight characteristics of the ball, the radii "r" and "R" preferably satisfy the following relationship:

$$R-0.1>r>R-0.4$$

The ratio d/D of a diameter "d" to a diameter D may be in a range of ⅕ or more, preferably, ¼ or more, and ⅘ or less, preferably, ¾ or less. If the ratio d/D is too small, the inclination of the side wall portion extending from the edge to the bottom portion of the dimple becomes too gentle, so that the dimple becomes analogous to the dimple having a circular-arc shape in cross section shown in FIG. 6, tending to lose the smoothness of the surface of the ball.

The depth "h" of the dimple having the convex bottom portion is preferably in a range of 0.05 mm or more, more preferably, 0.1 mm or more, and preferably, 0.3 mm or less, more preferably, 0.2 mm or less.

The circle defined by the radius "r" is not necessarily concentric with the circle defined by the radius "R", but is preferably concentric therewith.

According to the embodiment shown in FIG. 1, the radius "R" of the ball is a radius of a circular arc shown by an imaginary line (dashed line) 9 connecting land portions to each other, and the radius "r" of the bottom portion is set to a value "R−0.2" mm by setting the depth "h" (equal to "R−r") from the land portion extension line 9 to the surface of the bottom portion 5 to 0.2 mm. The diameter "d" of the dimple bottom portion, which is formed by the circular-arc (radius: "r") substantially concentric with the circular arc (radius: "R") of the ball in cross-section, is about a half of the diameter D of the dimple in a plan view.

According to the example shown in FIGS. 2 and 3, the dimples have three kinds (large, middle, small) of the diameters D, and it is assumed that all of the dimples have the convex bottom portions each of which is formed by the circular-arc defined by the radius "r" shown in FIG. 1.

According to the present invention, it is specified such that at least one or more of the dimples have convex bottom portions. In this case, the ratio of the dimples having convex bottom portions to the total of the dimples may be in a range of 50% or more, preferably, 75% or more, more preferably, 80%, most preferably, 100%.

The dimples may be arranged on the surface of the golf ball in accordance with any one of the known arrangement methods such as an icosahedron or octahedron arrangement method. It is to be noted that in the example shown in FIGS. 2 and 3, the dimples are arranged on the surface of the golf ball in accordance with the icosahedron arrangement method.

According to the present invention, the ratio CL/DL (CL: lift coefficient of ball during flight, DL: drag coefficient of ball during flight) is preferred to be in a range of 0.676 to 0.796 under a condition with a Reynolds number of 200,000 and a spin rate of 2,700 rpm, in a range of 0.813 to 0.933 under a condition with a Reynolds number of 120,000 and a spin rate of 2,400 rpm, and in a range of 0.856 to 0.976 under a condition with a Reynolds number of 80,000 and a spin rate of 2,000 rpm.

To be more specific, to ensure the long travel distance, particularly, against wind and prolong the run of a golf ball hit with a long-distance club such as a wood club #1 (driver), it is required to take a balance between the lift and drag of the ball during flight, and the travel distance of the golf ball is dependent on the kind, total number, surface occupied ratio, total volume, and the like of the dimples.

Figure 4:
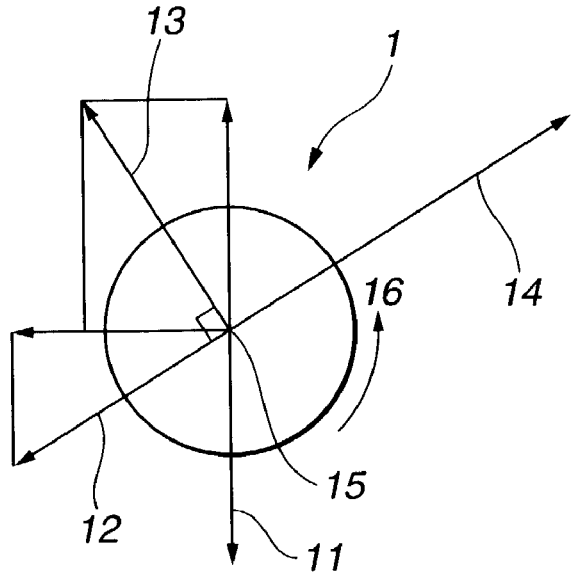
FIG. 4 is an illustrative view for illustrating a relationship between a lift and a drag of a golf ball during flight thereof.

It is known that as shown in FIG. 4, a golf ball 1 hit with a club receives, during flight, a gravitational force 11, an air resistance (drag) 12, and a lift 13 by a Magnus effect due to the spin of the ball. In the figure, reference numeral 14 denotes the flight direction, 15 is the center of the ball, and 16 is the rotational direction of the ball.

In this case, a force applied to the golf ball is expressed by the following trajectory equation:

$$F=FL+FD+Mg \tag{1}$$

Where F is a force applied to the golf ball, FL is a lift, FD is a drag, and Mg is a gravitational force.

The lift FL and the drag FD in the trajectory equation (1) are given by the following equations:

$$FL=0.5\times CL\times\rho\times A\times V^2 \tag{2}$$

$$FD=0.5\times CD\times\rho\times A\times V^2 \tag{3}$$

Where CL is a lift coefficient, CD is a drag coefficient, ρ is an air density, A is the maximum cross-sectional area of the golf ball, and V is an air speed against the golf ball.

According to the golf ball of the present invention, the flight characteristics of the golf ball can be improved by combining the configuration that the ratio CL/CD is specified within the above-described range with the configuration that the cross-sectional shape of the golf ball is set to that shown in FIG. 1.

According to the present invention, the structure and the materials of the golf ball are not particularly limited. For example, the golf ball of the present invention may be configured as a one-piece solid golf ball made from a single elastic material, a two-piece solid golf ball obtained by covering a center core made from an elastic material such as rubber with a cover made from a resin such as an ionomer resin or polyurethane, a multi-piece solid golf ball having three or more layers obtained by interposing, between a core and a cover, an intermediate layer portion composed of a single or two or more composite layers made from a resin material having physical properties different from those of a cover material.

According to the golf ball of the present invention, since the shapes of the dimples are optimized as described above, flight characteristics of the golf ball can be improved.

EXAMPLES

The present invention will be more apparent by way of the following Example and Comparative Example. These examples, however, should not be construed as limiting the present invention.

Figure 5:
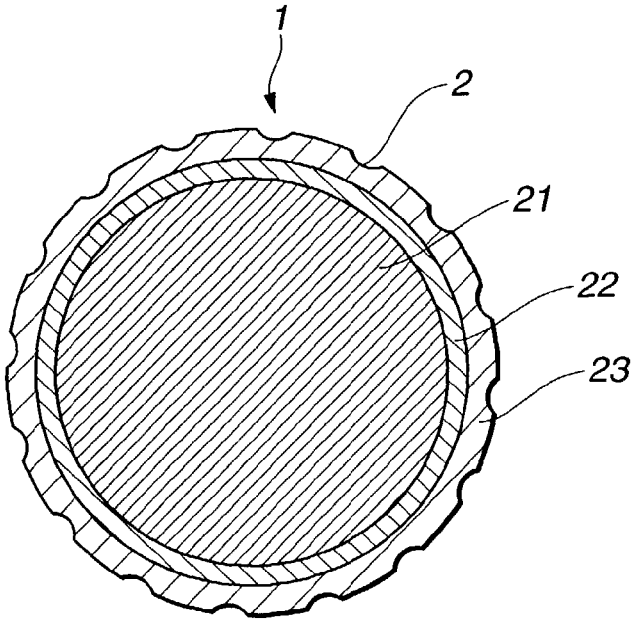
FIG. 5 is a schematic sectional view showing a layer structure of the golf ball according to the present invention.

FIG. 5 is a sectional view of a layer structure of a three-piece solid golf ball including a core 21 made from rubber, an intermediate layer 22 made from a resin material, and a cover 23 having a multiplicity of dimples on the surface thereof, wherein the cover is formed so as to cover the core and the intermediate layer.

Sample golf balls prepared in Example and Comparative Example each have the same layer structure as that shown in FIG. 5.

intermediate layer was 1.65 mm and the Shore D hardness of the intermediate layer, measured on the spherical surface, was 61; and the thickness of the cover was 1.5 mm and the Shore D hardness of the cover, measured on a land portion of the ball, was 58.

The dimples provided on the golf ball in Example were all configured as dimples having the same cross-sectional shapes as those shown in FIG. 1, and the dimples provided on the golf ball in Comparative Example were all configured as dimples having the same shapes as those shown in FIG. 6. The details of structures of the dimples are shown in Table 1. The arrangement of the dimples provided on the golf balls in Example and Comparative Example was set as shown in FIGS. 2 and 3. The arrangement shown in FIGS. 2 and 3 is characterized in that there is no great circle not crossing the dimples, and more specifically, the equator as one of the great circles crosses the dimples as shown in FIG. 3, that is, the dimples slightly crossing the equator are periodically arranged along the equator.

TABLE 1

| | Kind of dimples | Diameter D (mm) | Diameter d (mm) | Radius r (mm) of bottom portion | Depth (mm) | Number | | Total volume ($mm^3$) |
|---|---|---|---|---|---|---|---|---|
| Example | ① | 4.05 | 2.10 | 21.15 | 0.20 | 296 | 368 | 315 |
| | ② | 3.50 | 1.80 | 21.15 | 0.20 | 60 | | |
| | ③ | 2.40 | 1.15 | 21.15 | 0.20 | 12 | | |
| Comparative Example | ① | 4.05 | — | — | 0.25 | 296 | 368 | 313 |
| | ② | 3.50 | — | — | 0.22 | 60 | | |
| | ③ | 2.40 | — | — | 0.16 | 12 | | |

To confirm flight characteristics of the golf ball according to the present invention, the lift, the drag, and the flying distance of each of the sample golf balls prepared in one Example and one Comparative Example were measured.

Example and Comparative Example

The sample golf balls in Example and Comparative Example were each prepared as the three-layer solid golf ball shown in FIG. 5, wherein the core was formed by a single layer made from rubber, the intermediate layer was made from a composition containing an ionomer resin and an olefin based elastomer, and the cover was made from polyurethane elastomer. In each of the sample golf balls in Example and Comparative Example, the thickness of the In Table 1, the diameter (equivalent to 2R in FIGS. 1 and 6) of each of the golf balls in Example and Comparative Example is 42.7 mm; the diameter "D" is a diameter of the circle, surrounded by the edge, of the dimple, and the diameter "d" is a diameter of the circle, surrounded by the edge, of the convex bottom portion (formed by the circular-arc defined by the radius "r") as shown in FIGS. 1 and 6; and the depth in Example is equivalent to the value "h" shown in FIG. 1, and the depth in Comparative Example is equivalent to the value "i" shown in FIG. 6.

A comparison test was performed by mounting a driver (#1) to a hitting machine, and hitting each of the sample golf balls under a condition with an initial velocity of 72 m/s, a launch angle of 10°, and a spin rate of 2,700 rpm. The results of the test are shown in Table 2.

TABLE 2

| Position of ball | Velocity V (m/s) | Spin rate (rpm) | Reynolds number | | Example | Comparative Example |
|---|---|---|---|---|---|---|
| Immediately after launch | 72.0 | 2700 | 200000 | CL | 0.159 | 0.155 |
| | | | | CD | 0.220 | 0.233 |
| | | | | CL/CD | 0.723 | 0.670 |
| Maximum point | 41.4 | 2400 | 120000 | CL | 0.215 | 0.210 |
| | | | | CD | 0.247 | 0.255 |
| | | | | CL/CD | 0.870 | 0.824 |
| Minimum velocity point | 26.4 | 2000 | 80000 | CL | 0.257 | 0.256 |
| | | | | CD | 0.281 | 0.283 |
| | | | | CL/CD | 0.916 | 0.906 |

TABLE 2-continued

| Position of ball | Velocity V (m/s) | Spin rate (rpm) | Reynolds number | Example | Comparative Example |
|---|---|---|---|---|---|
| Flying Distance (m) | | | Carry | 242 | 239 |
| | | | Total | 261 | 258 |

In Table 2, the maximum point in the ball position column is a position of the ball during flight regarded as the maximum point (the highest point) by visual observation of an observer on the ground, and the minimum velocity point is a nearly intermediate point between the maximum point and the landing point.

From the results shown in Table 2, it is apparent that the flight characteristics (both the carry and total) of the golf ball in Example, which ball is configured such that the shapes of the dimples are specified according to the present invention and the ratio CL/CD is within the range specified according to the present invention, can be significantly improved.

While the preferred embodiment of the present invention has been described using specific terms, such description is for illustrative purposes only, and it is to be understood that many changes and variations may be made without departing from the spirit or scope of the following claims.

The invention claimed is:

1. A golf ball comprising a multiplicity of dimples on its outer surface, wherein at least one or more of said multiplicity of dimples are each configured to have a convex bottom portion formed by a circular-arc defined by a curvature radius "r" mm whose center is positioned inside said ball and the radius "r" mm of the convex bottom of the dimple and a radius "R" mm of said ball satisfy the following relationship:

$$R>r>R-0.5.$$

2. A golf ball according to claim 1, wherein said dimple having said convex bottom portion is formed into a circular shape in a plan view.

3. A golf ball according to claim 1, wherein a ration CL/CD of a lift coefficient CL to a drag coefficient CD of said ball during flight thereof is in a range of 0.676 to 0.796 under a condition with a Reynolds number of 200,000 and a spin rate of 2,700 rpm, in a range of 0.813 to 0.933 under a condition with a Reynolds number of 120,000 and a spin rate of 2,400 rpm, and in a range of 0.856 to 0.976 under a condition with a Reynolds number of 80,000 and a spin rate of 2,000 rpm.

4. A golf ball according to claim 1, wherein the circular-arc defined by the curvature radius "r" is substantially concentric with the circle defined by the radius "R".

5. A golf ball according to claim 1, wherein the radius "r" of the convex bottom of the dimple and the radius "R" of the ball satisfy the following relationship:

$$R-0.1>r>R-0.4.$$

6. A golf ball according to claim 1, wherein the depth "h" of the dimple is equal to "R−r".

7. A golf ball according to claim 1, wherein the ratio of the dimples having convex bottom portions to the total of the dimples is in a range of 50% or more.

8. A golf ball according to claim 1, wherein the ratio d/D of a diameter "d" of the dimple bottom portion to a diameter D of the dimple is in a range of ⅕to ⅘.

9. A golf ball comprising a multiplicity of dimples on its outer surface, wherein at least one or more of said multiplicity of dimples are each configured to have a convex bottom portion formed by a circular-arc defined by a center positioned inside said ball and a curvature radius "r" mm smaller than a radius "R" mm of said ball but larger than a value (R−0.5) mm, wherein said dimple having said convex bottom portion is formed into a non-circular shape in a plan view.

10. A golf ball according to claim 9, wherein a ratio CL/CD of a lift coefficient CL to a drag coefficient CD of said ball during flight thereof is in a range of 0.676 to 0.796 under a condition with a Reynolds number of 200,000 and a spin rate of 2,700 rpm, in a range of 0.813 to 0.933 under a condition with a Reynolds number of 120,000 and a spin rate of 2,400 rpm, and in a range of 0.856 to 0.976 under a condition with a Reynolds number of 80,000 and a spin rate of 2,000 rpm.

11. A golf ball according to claim 9, wherein dimple shapes of said multiplicity of dimples in a plan view includes at least one of a triangular shape, a quadrilateral shape, a hexagonal shape, an elliptic shape, an oval shape, a petal shape, a heart shape, a star shape, a dewdrop shape, and a combination thereof.

12. A golf ball according to claim 11, wherein the bottom portion of the dimple is formed into a non-circular shape in a plan view.

* * * * *